United States Patent [19]

Budzich

[11] 4,082,111

[45] Apr. 4, 1978

[54] LOAD RESPONSIVE FLUID CONTROL VALVE

[76] Inventor: Tadeusz Budzich, 80 Murwood Dr., Moreland Hills, Ohio 44022

[21] Appl. No.: 800,934

[22] Filed: May 26, 1977

Related U.S. Application Data

[63] Continuation-in-part of Ser. No. 729,696, Oct. 5, 1976, Pat. No. 4,028,889, and a continuation-in-part of Ser. No. 773,421, Feb. 28, 1977.

[51] Int. Cl.[2] ..... F15B 11/16

[52] U.S. Cl. ..... 137/596; 137/625.12; 91/436; 91/448; 60/420; 60/484

[58] Field of Search ..... 137/596, 625.12; 91/436, 448, 462; 60/420, 445, 484

[56] References Cited

U.S. PATENT DOCUMENTS

| | | | |
|---|---|---|---|
| 3,426,647 | 2/1969 | Martin et al. | 137/596 X |
| 3,470,694 | 10/1969 | Budzich | 91/448 X |
| 3,858,393 | 1/1975 | Budzich | 60/484 X |

*Primary Examiner*—Edgar W. Geoghegan

[57] ABSTRACT

A direction flow control valve for control of positive and negative loads equipped with a load responsive control which automatically blocks the pump flow to the motor while controlling negative load, providing the motor inlet with fluid from the motor exhaust.

11 Claims, 1 Drawing Figure

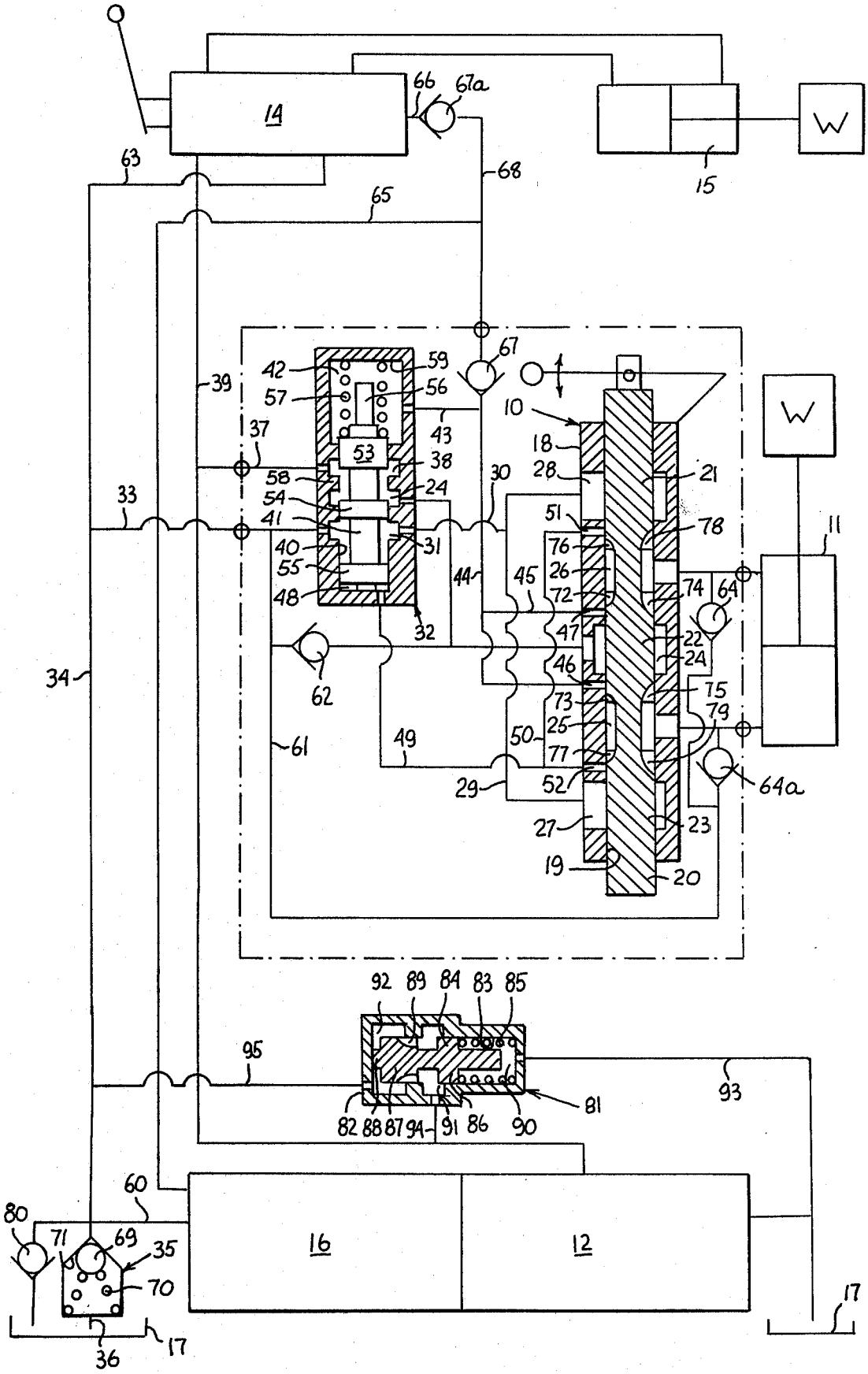
14
66
67a
W
15
63
68
65
67
42
59
57
56
39
10
43
37
53
38
18
28
21
58
24
30
33
54
51
78
41
11
40
31
76
26
55
44
45
74
64
48
72
32
47
22
24
62
46
34
73
15
25
79
61
49
50
77
29
52
64a
27
23
19
20
92
89
84
83
85
95
93
81
82
88
87
94
91
86
90
60
80
71
69
35
16
12
70
17
36
17

LOAD RESPONSIVE FLUID CONTROL VALVE

This is a continuation in part of application Ser. No. 729,696 filed Oct. 5, 1976 now U.S. Pat. No. 4,028,889 issued June 14, 1977 for "Load Responsive Fluid Control System" and of application Ser. No. 773,421 filed Feb. 28, 1977 for "Load Responsive Fluid Control Valve".

BACKGROUND OF THE INVENTION

This invention relates generally to load responsive fluid control valves and to fluid power systems incorporating such valves, which systems are supplied by a single fixed or variable displacement pump. Such control valves can be used in a multiple load system, in which a plurality of loads are individually controlled under positive and negative load conditions by separate control valves.

In more particular aspects this invention relates to direction and flow control valves capable of controlling simultaneously multiple positive and negative loads, which while controlling a negative load interrupt pump flow to the motor, providing the motor inlet with fluid from the pressurized system exhaust.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of the variation in magnitude of the load. A fluid control valve for such a system is shown in U.S. Pat. No. 3,488,953 issued to Haussler. The application of such a system is, however, limited by one basic system disadvantage.

Normally in such a system the load responsive valve uses flow from the pump not only while maintaining a constant pressure differential and therefore constant flow characteristics when operating a positive load, but also uses pump flow during operation of negative load.

This drawback can be overcome in part by provision of fluid control valves as disclosed in U.S. Pat. No. 3,807,447 issued to Masuda on Apr. 30, 1974. However, while these valves utilize actuator exhaust fluid for actuator inlet flow requirement when controlling negative loads, they regulate actuator inlet pressure by bypassing fluid to a down stream load circuit. Masuda's valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in fluid throttling loss. These valves are not adaptable to simultaneous control of multiple loads in parallel circuit and they do not provide system load control pressure signal to the pump flow control mechanism. The controllers of these valves respond to pressure differential developed across a metering orifice and not to negative load pressure.

SUMMARY OF THE INVENTION

It is therefore a principal object of this invention to provide improved load responsive fluid direction and flow control valves which block system pump from motor inlet and supply it with system exhaust flow when controlling negative loads.

Another object of this invention is to provide load responsive fluid direction and flow control valves, which load responsive fluid direction and flow control valves are provided with a pressurized exhaust manifold, flow from which supplies the inlet flow requirements of motors controlling negative loads.

It is a further object of this invention to provide load responsive fluid direction and flow control valves which retain their control characteristics during control of positive loads, while responding to a pressure differential developed across a variable orifice located between the pump and the actuator and during control of negative loads isolate system pump from inlet of the actuator, while responding to pressure in the actuator outlet.

It is a further object of this invention to provide improved load responsive fluid direction and flow control valves which block system pump from motor inlet and supply it with system exhaust flow when controlling negative loads, while transmitting control signals to system pump to maintain the pressure of the system pump higher, by a constant pressure differential, than the highest pressure of the system positive load being controlled.

Briefly the foregoing and other additional objects and advantages of this invention are accomplished by providing a novel load responsive fluid control system for use during control of multiple and negative loads. The system load is controlled in respect to pressure signal transmitted from system valves, corresponding to the highest system load pressure. Exhaust circuit of the system is pressurized, the exhaust flow being used to provide inlet flow requirements of motors controlling negative loads.

Additional objects of this invention will become apparent when referring to the preferred embodiments of the invention as shown in the accompanying drawing and described in the following detailed description.

DESCRIPTION OF THE DRAWING

The lone drawing FIGURE is a longitudinal sectional view of an embodiment of a flow control valve having a positive load control responsive to actuator upstream pressure differential and negative load pump cut off controls responsive to actuator down stream pressure for use in load responsive fluid control system, with lines, system flow control, system pump, second load responsive valve, exhaust relief valve and system reservoir shown diagramatically.

DESCRIPTION OF THE PREFERRED EMBODIMENT

Referring now to the drawing, an embodiment of a flow control valve, generally designated as 10, is shown interposed between diagramatically shown fluid motor 11 driving load W and a pump 12 of a fixed displacement or variable displacement type driven by a prime mover not shown. Although the control components of the flow control valve, diagramatically shown, are separated, those enclosed by the dotted line preferably would be combined in one housing and constitute a single control module.

Similarly, a flow control valve 14, identical to flow control valve 10, is interposed between a diagramatically shown fluid motor 15 driving a load W and the pump 12. Fluid flow from the pump 12 to flow control valves 10 and 14 is regulated by a pump flow control 16. If pump 12 is of a fixed displacement type pump flow control 16 is a differential pressure relief valve, which in a well known manner, by bypassing fluid from the pump 12 to a reservoir 17, maintains discharge pressure of pump 12 at a level, higher by a constant pressure differential, than load pressure developed in fluid motor 11 or 15. If pump 12 is of a variable displacement type flow control 16 is a differential pressure compensator, well known in the art, which by changing displacement of pump 12 maintains discharge pressure of pump 12 at a level, higher by a constant pressure differential, than load pressure developed in fluid motor 11 or 15.

The flow control valve 10 is of a fourway type and has a housing 18 provided with a bore 19 axially guiding a valve spool 20. The valve spool 20 is equipped with lands 21,22 and 23, which in neutral position of the valve spool 20, as shown in the drawing, isolate a fluid supply chamber 24, load chambers 25 and 26 and outlet chambers 27 and 28. Outlet chambers 27 and 28 are connected through lines 29 and 30 with space 31 of cut off valve 32, which in turn is connected through line 33 and exhaust line 34 to an exhaust relief valve, generally designated as 35, which through line 36 is connected to the reservoir 17.

The pump 12 through its discharge line 37 and load check valve not shown is connected to a fluid inlet chamber 38 of cut off valve 32. Similarly discharge line 39 is connected through load check valve not shown with the inlet chamber of the fluid control valve 14. The control bore 40 connects the fluid inlet chamber 38 with the fluid supply chamber 24. The cut off spool 41, axially slidable in the control bore 40, projects on one end into space 42 connected by lines 43, 44 and 45 with positive load sensing ports 46 and 47. The cut off spool 41 on the other end projects into control space 48, which is connected by lines 49 and 50 with the negative load sensing ports 51 and 52. The cut off spool 41 is provided with land 53 isolating space 42 from the inlet chamber 38, land 54 isolating inlet chamber 38 and supply chamber 24 from space 31, land 55 isolating space 31 from control space 48 and stop 56. The cut off spool 41 is biased by a control spring 57 towards position, in which fluid inlet chamber 38 and fluid supply chamber 24 are interconnected. Upward displacement of the cut off spool 41, from the position as shown, will isolate with land 54, engaging web 58, the inlet chamber 38 from the supply chamber 24, while automatically connecting the supply chamber 24 with space 31. The maximum displacement of the cut off spool 41 is limited by surface 59.

If the pump 12 is of a fixed displacement type excess pump flow from the differential pressure relief valve or pump flow control 16 is delivered through line 60 to the exhaust line 34, which communicates with the space 31, outlet chambers 27 and 28, a bypass check valve 62, anti-cavitational check valves 64 and **64*a*, the exhaust relief valve 35 and through line 63 with all of the exhaust passages of the flow control valve 14. The bypass check valve 62 is interposed between line 61 and the fluid supply chamber 24, while anti-cavitational check valves 64 and 64*a* are interposed between line 61 and load chambers 26 and 25** respectively.

Positive load sensing ports 46 and 47, located between load chambers 25 and 26 and the supply chamber 24 and blocked in neutral position of valve spool 20 by land 22, are connected through signal lines 44 and 45, a check valve 67 and signal line 65 to the pump flow control 16. In a similar manner positive load sensing ports of flow control valve 14 are connected through line 66, a check valve **67*a*, line 68 and signal line 65 to the pump flow control 16**.

The exhaust relief valve, generally designated as 35, interposed between combined exhaust circuits of flow control valves 10 and 14 including bypass circuit of pump 12 and reservoir 17, is provided with a throttling member 69 biased by a spring 70 towards engagement with seat 71.

The land 22 of the valve spool 20 is equipped with signal slots 72 and 73 located in the plane of positive load sensing ports 47 and 46 and metering slots 74 and 75 which in a well known manner can be circumferentially spaced in respect to each other and in respect to the signal slots 72 and 73. Signal slots 72 and 73, in a well known manner, can be substituted by end surfaces of land 22. A suitable device is provided to prevent relative rotation of the spool 20 in respect to bore 19. Lands 21 and 23 of the valve spool 20 are equipped with signal slots 76 and 77, located in the plane of negative load sensitive ports 51 and 52 and metering slots 78 and 79, circumferentially spaced in respect to each other and to signal slots 76 and 77.

The preferable sequencing of the cut off spool 41 is such that when moved upward, when top face of land 54 closes communication between between the inlet chamber 38 and the supply chamber 24, bottom face of land 54 is positioned at the point of opening communication between the supply chamber 24 and space 31. Further movement of the cut off spool 41 upward will gradually establish full flow communication between space 31 and the supply chamber 24.

The sequencing of the lands and slots of valve spool 20 preferably is such that when displaced in either direction from its neutral position, as shown in FIG. 1, one of the load chambers 25 or 26 is first connected by the signal slot 72 or 73 to the positive load sensing port 47 or 46 while load chambers 25 and 26 are still isolated from the supply chamber 24 and the outlet chambers 27 and 28. Further displacement of the valve spool 20 from its neutral position, connects load chamber 25 or 26 by the signal slots 76 or 77 with negative load sensing ports 51 or 52, while land 22 still isolates the supply chamber 24 from load chambers 25 and 26 and lands 21 and 23 still isolate load chamber 25 or 26 from the outlet chamber 27 and 28. Still further displacement of valve spool 20 will connect load chamber 25 or 26 through metering slots 75 or 74 with the fluid supply chamber 24 while lands 21 or 23 will connect through metering slots 78 or 79 outlet chambers 27 and 28 with the load chamber 25 or 26.

As previously described the pump flow control 16, in a well known manner, will regulate fluid flow delivered from pump 12 to discharge line 45, to maintain the pressure in discharge line 39 higher, by a constant pressure differential, than the highest load pressure signal transmitted through the check valve system to the signal line 65. Therefore with valve spools of flow control valves 10 and 14 in their neutral position blocking positive load sensing ports 46 and 47, signal pressure inlet to the pump flow control 16 from the signal line 65 will be at minimum pressure level.

With pump 12 of a fixed displacement type started up the pump flow control 16 will bypass through line 60, the exhaust relief valve 35 and line 36 all of pump flow to the system reservoir 17 at minimum pressure level equivalent to preload in the spring 70, while automatically maintaining pressure in discharge line 39 at a constant pressure, higher by a constant pressure differential, than pressure in signal line 65 or pressure in exhaust line 34. Therefore all of pump flow is diverted by the pump flow control 16 to the low pressure exhaust circuit, as previously described, without being used by flow control valves 10 and 14. Supply chamber 24 is connected through bypass check valve 62 with pressure existing in exhaust line 34. The pressure setting of exhaust relief valve 35 is selected to provide the necessary pressure drop through metering slots 74 and 75 to maintain load chamber 25 or 26 at above atmospheric pressure. With the use of anti-cavitational check valves 64 and 64*a* the pressure setting of the exhaust relief valve can be substantially reduced.

With pump 12 of a variable displacement type started up minimum flow to the system exhaust manifold, composed of exhaust line 34 and exhaust pressure relief valve 35, is supplied from the leakage circuit of pump 12, to maintain the system exhaust manifold pressurized. A pressure reducing type regulator can be used, which upon system exhaust manifold pressure dropping below the setting of the exhaust pressure relief valve 35, will throttle some of the pump discharge flow and supply it to the exhaust manifold, to maintain it at a certain preselected minimum pressure level. Such pressure reducing type regulator is shown in the drawing and will be described later.

Assume that the load chamber 25 is subjected to a positive load. The initial displacement of the valve spool 20 upward will connect through signal slot 73 the load chamber 25 with the positive load sensing port 46. Positive load pressure signal, from the positive load sensing port 46, will be transmitted through line 44, check valve system and signal line 65 to the pump flow control 16, as previously described and will increase the pressure in discharge line 39 to a level, which is higher by a constant pressure differential than the load signal pressure. This positive load pressure from the positive load pressure sensing port 46 will also be transmitted by line 43 to space 42 of the cut off valve 32 where, reacting on the cross-sectional area of the cut off spool 41, will maintain it in the position as shown in the drawing, maintaining full flow communication between the inlet chamber 38 and the supply chamber 24. Further displacement upward of the valve spool 20 will connect through signal slot 76 the load chamber 26 with the negative load sensing port 51, which is connected through lines 50 and 49 with control space 48 in the cut off valve 32. Since the load chamber 25 is subjected to a positive load pressure, the load chamber 26 is subjected to low pressure and so is control space 48. Therefore during control of positive load, the cut off spool 41 is subjected to a pressure differential, maintaining it in a position to provide an uninterrupted flow between the inlet chamber 38 and the supply chamber 24. Further displacement upward of valve spool 20 will open a flow passage through metering slots 75, between the load chamber 25 and the supply chamber 24, while also opening a flow passage through metering slots 78, between the load chamber 26 and the outlet chamber 28. Since a constant pressure differential is maintained by the pump flow control 16, between the supply chamber 24 and the load chamber 25, fluid flow between these chambers will be proportional to the effective area of metering slots 75, which in turn is proportional to the displace of the valve spool 20 from its neutral position.

Assume that the load chamber 25 is subjected to a negative load pressure. The initial displacement of the valve spool 20 downward will connect, through signal slots 72, the load chamber 26 with the positive load sensing port 47. Since load chamber 26 is subjected to a low pressure, in a manner as previously described, low pressure signal will be transmitted to the pump flow control 16 and to space 42 of the cut off valve 32. The pump 12 will be then maintained at a minimum standby pressure level and the cut off spool 41 will be maintained, in the position as shown in the drawing, by the biasing force of control spring 57. Further movement downward of the valve spool 20 will connect through signal slot 77 the load chamber 25 with the negative load sensing port 52. Therefore high negative load pressure signal will be transmitted from negative load sensing port 52 through line 49 to control space 48 where, reacting on the cross-sectional area of the cut off spool 41, will move it against biasing force of control spring 57 all the way upward, with stop 56 engaging surface 59. In this position cut off spool 41 with land 54 will close communication between the inlet chamber 38 and the supply chamber 24, while fully connecting supply chamber 24 with space 31 and therefore with pressurized system exhaust manifold. During control of negative load, as long as the force generated on the cross-sectional area of the cut off spool 41, by the negative load pressure, exceeds the biasing force of the control spring 57, the cut off spool 41 will be maintained in its upward position.

Further displacement of the valve spool 20 downward will connect, through metering slots 79, the load chamber 25 with the outlet chamber 27, while also connecting through metering slots 74 the load chamber 26 with the supply chamber 24. The fluid under high negative load pressure will be throttled by the metering slots 79, while flowing from the load chamber 25 to the outlet chamber 27. The outlet flow from the outlet chamber 27 will be supplied through lines 29 and 30 to space 31, which communicates with the pressurized exhaust manifold of the system. Since with the cut off spool 41 in its upward position the supply chamber 24 is connected to space 31 and to the pressurized exhaust manifold, the pressurized exhaust fluid will be supplied from the supply chamber 24, through metering slots 74, to the load chamber 26, supplying the inlet flow requirements of the fluid motor 11. Space 31 is also connected by line 61 with bypass check valve 62, providing additional direct connection for flow of fluid from the system's exhaust manifold to the supply chamber 24. The inlet flow requirement of the fluid motor 11 can also be directly supplied by anti-cavitational check valves 64 and 64*a*. Due to the flow through metering slots 79 any pressure drop in the load chamber 26, below the pressure level of the pressurized exhaust manifold, will open anti-cavitational check valve 64, which will supply through line 61 all of the inlet flow requirements of the fluid motor 11 from the pressurized exhaust manifold. Therefore during control of negative load the pump 12 is automatically blocked from the valve supply chamber and the motor inlet flow requirements are supplied from motor outlet flow and from the pressurized exhaust manifold, providing great savings in power and extending the capacity of the system pump to perform useful work.

If the negative load pressure is very low, additional energy must be supplied from the pump circuit to negative load W which is too small to provide by its potential energy the required velocity for its control. The minimum pressure, at which the negative load is allowed to provide energy for its control, is determined by the preload in the control spring 57. This minimum negative load pressure may be made equal to the minimum system standby pressure, as determined by the characteristics of the pump flow control 16. Although the load control features, when using fixed or variable displacement pump, are identical, the amount of flow delivered to exhaust circuit and specifically to exhaust line 34 is different in each case. With fixed displacement pump all of the excess pump flow is delivered by the differential pressure relief valve 16 through line 60 to exhaust line 34. With system valve spools in neutral position all of the pump flow is directed by the differential pressure relief valve 16 to exhaust line 34. When the pump 12 is of a variable displacement type, it supplies the exact amount of fluid to satisfy the system demand, none of the pump flow being normally diverted to exhaust line 34. Therefore when using variable displacement pump less exhaust flow is available to satisfy inlet flow requirements of system actuators during control of negative loads. Normally an actuator, in the form of a cylinder, due to presence of piston rod, displaces different flows from each cylinder port per unit length displacement of its piston. Therefore, while controlling negative load, the exhaust flow out of the cylinder might be substantially smaller than its inlet flow requirements. Under these conditions, since combination between the inlet chamber 38 and the supply chamber 24 is blocked by the cut off spool 41, exhaust pressure level, as maintained by exhaust pressure relief valve 35 will drop below atmospheric pressure, the exhaust pressure relief valve 35 will close entirely and cavitation will take place at the inlet side of the cylinder. In a well known manner an anticavitation check valve 80 is provided between exhaust line 34 and reservoir 17, but since it can only function below atmospheric pressure, the cavitation condition at actuator inlet would still likely occur.

To prevent cavitation and to maintain exhaust line 34 at minimum pressure level a pressure reducing valve, generally designated as 81, is provided. Pressure reducing valve 81 has a valve housing 82 provided with a valve bore 83 axially guiding a valve spool 84, which is biased towards position as shown in the drawing by a spring 85. The valve spool 84 is provided with lands 86 and 87, stop 88 and throttling slots 89. The valve housing 82 is provided with space 90 and chambers 91 and 92. Space 90 is connected through line 93 with the reservoir 17. The chamber 91 is connected by line 94 with discharge line 39, which is supplied with fluid under pressure from the pump 12. The chamber 92 is connected by line 95 with exhaust line 34. Fluid under pressure is supplied from pump 12, discharge line 39 and line 94 to the chamber 91 and through throttling slots 89 to the chamber 92, which is connected by line 95 with exhaust line 34. Pressure in the chamber 92 and in the exhaust system will begin to rise and reacting on the cross-sectional area of valve spool 84 will tend to move it from left to right, compressing the spring 85 and closing the passage through throttling slots 89 between chambers 92 and 91. In this way pressure reducing valve 81, will throttle fluid flow from chamber 91 to chamber 92 and therefore to exhaust line 34, to maintain exhaust line 34 at a constant pressure, as dictated by the preload in the spring 85. This constant controlled pressure level is selected below controlled pressure level of exhaust pressure relief valve 35. As long as the exhaust pressure relief valve 35 maintains the exhaust system at its controlled pressure level, communication between chambers 91 and 92, of pressure reducing valve 81, will be closed and no flow from the pump 12 will be diverted into the exhaust circuit, to maintain it at a minimum constant pressure level. However, during control of negative load once the actuator inlet flow requirement will exceed the actuator outlet flow, the exhaust pressure relief valve 35 will close, pressure in the exhaust system will drop to the control pressure setting of the pressure reducing valve 81 and the motor exhaust flow will be supplemented from the pump circuit by the pressure reducing valve 81, to maintain the actuator inlet at the required pressure. Therefore during control of negative load only the difference between the actuator inlet flow requirement and the actuator exhaust flow will be supplied to the exhaust circuit from the pump 12. This feature not only improves the efficiency of the system, but greatly extends the capacity of the pump of variable displacement type to perform useful work in control of positive loads.

The load can only be either positive or negative and therefore high pressure signal can only be transmitted from positive load sensing ports or negative load sensing ports. The cut off spool 41 of the drawing is subjected to a pressure differential between pressures in negative and positive load sensing ports. Similar results can be obtained by retaining the connection between the control space 48 and the negative load sensing ports 51 and 52 and connecting space 42, in cut off valve 32, to exhaust line 34. Then, during control of negative load, negative load pressure, acting on the cross-sectional area of the cut off spool 41, will move it upward against the biasing force of control spring 57, cutting off communication between the inlet chamber 38 and the supply chamber 24.

Since bypass check valve 62 is capable of connecting supply chamber 24 with the system exhaust manifold, the connecting function of the cut off spool 41 can be dispensed with. When supplying inlet flow requirement of fluid motor 11, through bypass check valve 62, the pressure setting of the exhaust relief valve 35 must be increased, to compensate for pressure drop in positive load metering slots 74 and 75. When using anti-cavitational check valves 64 and **64*a* the inlet flow requirement of the fluid motor 11** can be supplied at much lower exhaust pressure and much higher speeds, during control of negative load, can be achieved without excessive exhaust pressurization.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly supplied with pressure fluid by a pump, said valve assembly comprising a housing having a fluid inlet chamber, a fluid supply chamber, first and second load chambers, and fluid exhaust means, first valve means for selectively interconnecting said fluid load chambers with said fluid supply chamber and said fluid exhaust means, first variable metering orifice means responsive to movement of said first valve means and operable to throttle fluid flow between said fluid supply chamber and said load chambers, second variable metering orifice means responsive to movement of said first valve means and operable to throttle fluid flow between said load chambers and said fluid exhaust means, second valve means having inlet fluid isolating means between said fluid inlet chamber and said fluid supply chamber, actuating means in said fluid isolating means operable to isolate by said fluid isolating means said fluid inlet chamber from said load chambers when one of said load chambers is interconnected to said fluid exhaust means by said first valve means and said load chamber is pressurized, and fluid replenishing means operable to supply fluid flow from said fluid exhaust means to one of said load load chambers which is not pressurized when said fluid isolating means isolate said fluid inlet chamber from said fluid load chambers.

2. A valve assembly as set forth in claim 1 wherein said valve assembly has negative load pressure sensing means in said housing selectively communicable with said load chambers by said first valve means.

3. A valve assembly as set forth in claim 2 wherein said actuating means in said inlet fluid isolating means has means responsive to pressure in said negative load sensing means.

4. A valve assembly as set forth in claim 1 wherein said valve assembly has positive load pressure sensing means in said housing selectively communicable with said load chambers by said first valve means.

5. A valve assembly as set forth in claim 4 wherein said positive load pressure sensing means has means operable to transmit positive load pressure signal to said pump.

6. A valve assembly as set forth in claim 1 wherein said valve assembly has negative load sensing means selectively communicable with said load chambers by said first valve means and positive load sensing means selectively communicable with said load chambers by said first valve means, said actuating means in said fluid inlet isolating means having means responsive to pressure differential between said negative load sensing means and said positive load sensing means.

7. A valve assembly as set forth in claim 1 wherein said fluid replenishing means has exhaust fluid pressurizing means in said fluid exhaust means.

8. A valve assembly as set forth in claim 1 wherein said inlet fluid isolating means has exhaust fluid connecting means operable to connect said fluid supply chamber with said fluid exhaust means when said fluid supply chamber is isolated from said inlet chamber.

9. A valve assembly as set forth in claim 1 wherein said fluid replenishing means has check valve means interconnecting for one way fluid flow said fluid exhaust means and said fluid supply chamber.

10. A valve assembly as set forth in claim 1 wherein said fluid replenishing means has check valve means interconnecting for one way fluid flow said fluid exhaust means and said fluid load chamber which is not pressurized.

11. A valve assembly as set forth in claim 7 wherein constant pressure reducing valve means interconnects said inlet chamber of said valve assembly and said fluid exhaust means upstream of said exhaust fluid pressurizing means and operable to maintain said fluid exhaust means upstream of said exhaust fluid pressurizing means at a relatively constant pressure level lower than pressure setting of said exhaust fluid pressurizing means when said exhaust pressure pressurizing means stop passing fluid from said fluid exhaust means.

* * * * *